US009500062B2

(12) United States Patent
Tveiten et al.

(10) Patent No.: US 9,500,062 B2
(45) Date of Patent: Nov. 22, 2016

(54) VALVE DEVICE OF A WELLHEAD CHRISTMAS TREE ASSEMBLY

(75) Inventors: Magnar Tveiten, Sandnes (NO); Erling Kleppa, Jorpeland (NO); Øyvind Stokka, Sandnes (NO)

(73) Assignee: PETROLEUM TECHNOLOGY COMPANY AS, Stavanger (NO)

( * ) Notice: Subject to any disclaimer, the term of this patent is extended or adjusted under 35 U.S.C. 154(b) by 399 days.

(21) Appl. No.: 13/578,628

(22) PCT Filed: Feb. 14, 2011

(86) PCT No.: PCT/EP2011/052137

§ 371 (c)(1),
(2), (4) Date: Sep. 25, 2012

(87) PCT Pub. No.: WO2011/098602

PCT Pub. Date: Aug. 18, 2011

(65) Prior Publication Data

US 2013/0291961 A1 Nov. 7, 2013

(30) Foreign Application Priority Data

Feb. 15, 2010 (NO) ..... 20100222

(51) Int. Cl.
*E21B 34/02* (2006.01)
*E21B 33/06* (2006.01)
*E21B 33/068* (2006.01)

(52) U.S. Cl.
CPC ..... *E21B 34/02* (2013.01); *E21B 33/068* (2013.01); *Y10T 137/6851* (2015.04)

(58) Field of Classification Search
CPC ..... E21B 33/068; E21B 33/03; E21B 34/02
USPC ..... 166/379, 386, 97.1, 86.1, 95.1
See application file for complete search history.

(56) References Cited

U.S. PATENT DOCUMENTS

| | | | | |
|---|---|---|---|---|
| 2,250,244 | A | 7/1941 | Vancey | |
| 2,927,643 | A * | 3/1960 | Dellinger | E21B 33/03 166/75.11 |
| 3,379,255 | A * | 4/1968 | Burns, Jr. et al. | 166/55 |
| 3,426,845 | A * | 2/1969 | Dollison | 166/72 |
| 4,125,155 | A * | 11/1978 | Brock, Jr. | 166/87.1 |
| 4,184,504 | A | 1/1980 | Carmichael et al. | |
| 4,258,786 | A * | 3/1981 | Lochte et al. | 166/72 |
| 4,304,261 | A * | 12/1981 | Forester | E21B 34/02 137/613 |

(Continued)

FOREIGN PATENT DOCUMENTS

| | | | | |
|---|---|---|---|---|
| GB | 2351103 | Y | 12/2000 | |
| GB | 2389599 | | 12/2003 | |
| NO | WO 2009102214 | A1 * | 8/2009 | E21B 33/03 |
| WO | WO 2006/133350 | A2 | 12/2006 | |
| WO | 2009/102214 | | 8/2009 | |
| WO | WO 2009102214 | Y | 8/2009 | |

OTHER PUBLICATIONS

Search report from Singapore Patent Office dated Nov. 7, 2013.

*Primary Examiner* — Jennifer H Gay
(74) *Attorney, Agent, or Firm* — Birch, Stewart, Kolasch & Birch, LLP

(57) ABSTRACT

A valve (1) having at least one flange portion (2, 3) for securing to a wellhead Christmas tree (5) for shutting off a pipe outlet (50) from the wellhead Christmas tree (5). At least one of the flange portions (2) includes integrated devices (6*a*, 6*b*, 6, 14, 15) for operation of a second unit (10) mounted outside the valve (1).

8 Claims, 4 Drawing Sheets

(56) References Cited

U.S. PATENT DOCUMENTS

| | | | | |
|---|---|---|---|---|
| 4,460,039 | A | 7/1984 | Knight | |
| 4,513,823 | A * | 4/1985 | Hynes | E21B 34/04 166/316 |
| 4,562,888 | A * | 1/1986 | Collet | 166/97.1 |
| 4,681,133 | A * | 7/1987 | Weston | 137/315.18 |
| 4,703,807 | A * | 11/1987 | Weston | 166/373 |
| 5,575,336 | A * | 11/1996 | Morgan | 166/330 |
| 5,918,676 | A * | 7/1999 | Edwards | 166/373 |
| 6,062,314 | A * | 5/2000 | Nobileau | 166/368 |
| 7,275,591 | B2 * | 10/2007 | Allen et al. | 166/86.1 |
| 8,684,073 | B2 | 4/2014 | Sevheim et al. | |
| 2002/0100592 | A1 * | 8/2002 | Garrett et al. | 166/378 |
| 2006/0060348 | A1 * | 3/2006 | Allen et al. | 166/75.14 |
| 2008/0029271 | A1 * | 2/2008 | Bolding | E21B 33/03 166/368 |
| 2008/0230226 | A1 | 9/2008 | Lam et al. | |
| 2009/0000781 | A1 | 1/2009 | Bolding | |
| 2009/0090515 | A1 | 4/2009 | Chan et al. | |
| 2009/0272522 | A1 * | 11/2009 | Ring et al. | 166/86.1 |
| 2010/0230114 | A1 * | 9/2010 | Jennings | 166/377 |
| 2011/0240298 | A1 * | 10/2011 | Rota et al. | 166/320 |
| 2012/0152564 | A1 * | 6/2012 | Peltier | 166/373 |
| 2013/0291961 | A1 * | 11/2013 | Tveiten et al. | 137/343 |
| 2013/0299162 | A1 * | 11/2013 | Soltvedt | 166/244.1 |
| 2014/0020906 | A1 * | 1/2014 | Travis | E21B 34/02 166/345 |

* cited by examiner

VALVE DEVICE OF A WELLHEAD CHRISTMAS TREE ASSEMBLY

CROSS-REFERENCE TO RELATED APPLICATIONS

This application is a U.S. National stage of PCT/EP2011/052137.

FIELD OF THE INVENTION

The present invention relates to a valve for securing to a wellhead Christmas tree for shutting off a pipe outlet from the wellhead Christmas tree.

BACKGROUND OF THE INVENTION

A wellhead Christmas tree has a plurality of outlets where valves are placed in connection with these outlets for control of these outlets. These valves are then mounted externally on a large structure and may be subject to damage, for example in the event of falling loads. If the valve is damaged and/or is also completely knocked off, the outlet from the wellhead Christmas tree will be open to the environment. This will result in spillage to the environment and is therefore not desirable. A possible solution to this is to provide an extra barrier valve internally in the actual bore outlet of the wellhead Christmas tree leading out to the valve which may be damaged. This extra barrier valve will have a fail safe closed position. A solution of this kind is described, for example, in the applicant's own Norwegian application NO20080211, entered as PCT application with publication number WO2009102214. This ensures that in the event of damage due to falling loads there is no spillage to the environment.

In order to install an extra valve in the bore outlet, the external valve normally has to be uncoupled in order to insert a distance piece between the wellhead Christmas tree and the outer valve, which distance piece is intended for use as a hydraulic chamber for the extra internal valve. Furthermore, the pipe system outside the Christmas tree has to be adapted so as to make room for this distance piece. This distance piece must be included in the assembly as the extra valve which has to be placed in the bore outlet has a control unit/actuator extending slightly beyond the valve and therefore outside the Christmas tree. This control unit/actuator may therefore extend into the main channel in towards the main valve and may possibly hinder closing/opening of the main valve. Thus it is necessary to have a distance piece, and in addition it is also necessary to supply control fluid to the actuator which is to be placed in the bore outlet. This process of installing a distance piece is time-consuming and there is therefore a need for a simpler solution for installation of a valve in the bore outlet in a wellhead Christmas tree.

BRIEF SUMMARY OF THE INVENTION

An object of the present invention is therefore to provide a simpler solution for installation of an extra valve in the bore outlet in a wellhead Christmas tree inside a main valve. This is achieved with a main valve according to the following claims.

A valve is provided comprising at least one flange portion for securing to a wellhead Christmas tree for shutting off a pipe outlet from the wellhead Christmas tree. According to the invention at least one of the flange portions comprises integrated devices for operation of a second unit mounted outside this valve.

According to an aspect of the invention the integrated devices may comprise at least one bore from an outside of the flange to a main channel in the valve. The main channel, which is the flow passage in the valve, passes through the flange portions. The main channel in the valve is also the channel which the valve body in the valve closes and opens when activating the valve. The main channel is normally arranged in line with the pipe outlets to which the valve is connected. In a variant of the valve there may be several bores from an outside of the flange to one or more positions in the main channel. These additional bores may be for operation of the unit, but may also be for conducting other activities in the main channel such as pressure reading, chemical injection, injection of sealing compound etc.

According to another aspect the devices may comprise arrangements for activation of a mechanical device for operation of the unit. This means that at least a part of a control module for the unit which has to be controlled is arranged internally in the body of the valve. In a variant this may be a piston unit which is connected to a mechanical arm extending into the main channel of the valve when it is activated. The mechanical arm extending into the main channel may therefore interact with the unit located in the bore outlet, and if this is a valve, open or close it.

According to another aspect the main channel may be configured to receive at least a part of a control unit for the unit, which control unit can be connected to the bore via the flange for activation of the unit. The main channel may, for example, comprise suitable surfaces for receiving and interacting with gripping and sealing elements of a control unit. Alternatively, the main channel may comprise an edge or other gripping device for control and receipt of a control unit.

In an embodiment the main channel may comprise anchor surfaces for mounting the control unit for the unit. Anchors for the control unit may be slips, grips, eccentric solutions, dogs, and/or shoulders. These anchor surfaces may be smooth or rough in order to give a better grip between the control unit and the main channel.

According to a further aspect the main channel may comprise at least one sealing surface. This sealing surface is adapted to interact with seals between the control unit and the main channel. In one case the bore from the outside of the flange to the main channel may end inside the main channel in the middle of a sealing surface. On this one sealing surface two seals of the control unit may be arranged when the latter is mounted. Alternatively, the two seals may each have a sealing surface arranged on each side of the outlet of the bore in the main channel.

According to an aspect of the invention the unit which has to be controlled via the devices in the flange may be a valve which regulates through-flow through the main channel. This may be a valve which is mounted in the actual bore outlet from a wellhead Christmas tree and which will not be damaged in the event of falling loads since the actual valve is mounted internally in the body of the Christmas tree. Any control unit for this valve will be located at least partly in a valve which will be able to be damaged by falling loads. This means that the valve which has to be mounted in the actual bore outlet has a fail safe closed position if control fluid fails and the wellhead Christmas tree is secured with respect to spillage to the environment.

According to a further aspect the flange portion may extend in the longitudinal direction of the main channel in such a manner that it can contain a control unit for the external unit without getting in the way of the valve body of the valve. In this case the term "contain the control unit" should include both when the control unit is placed inside the main channel and where it is only a single bore from the outside of the flange into the control unit, but also where at least a part of the control unit is integrated in the material of the valve/flange, where the part of the control unit which is not located in the material is placed in the main channel.

According to yet another aspect at least a part of the control unit may be integrated in the valve material. Hydraulic and/or electric and/or pneumatic/electromagnetic parts of the control unit may be arranged in the valve material. A variant may also be envisaged where, for example, the hydraulic part of the control unit is mounted externally or in an external recess with access thereto from the outside of the flange, with a transfer in through the bore to the unit in the wellhead Christmas tree.

According to an embodiment the control unit may be mounted internally in the main channel in the valve. In an embodiment the main channel and control unit may be configured in such a manner that a diameter of the main channel is maintained in the portion where the control unit is mounted. Alternatively, the main channel where the control unit is mounted may thereby be reduced. A circular control unit may be envisaged with internal diameter corresponding to the main channel, or also another configuration where the control unit is placed at one side of the main channel. Alternatively, the control unit may also be placed more in the middle of the main channel with a flow passage round the circumference or round parts of the circumference. The main channel of the main valve must be equal to or larger than the inlet in the wellhead Christmas tree, thereby enabling the unit which has to be controlled to be sluiced via the valve. The control unit and/or the main channel may have another shape than circular, for example triangular, rounded, rectangular or another shape.

According to an aspect the control unit may be hydraulically, pneumatically, electrically, electromagnetically and/or mechanically operated. The control unit may, for example, be a unit comprising an inlet from the bore through the material of the valve, where this inlet leads to a chamber which, when pressurised, activates a piston, which is moved towards the valve, whereby it pushes an element, for example a movable sleeve, of the valve, thereby opening it. In this case the control unit will comprise seals between the control unit and the main channel for transfer of hydraulic fluid. Alternatively, if the hydraulic unit is located in the material, the control unit may, for example, comprise a mechanical device activated by a mechanical device in the material and transfer this movement to the valve for activation thereof.

BRIEF DESCRIPTION OF THE DRAWINGS

The invention will now be explained with reference to a non-limiting example, with reference to the attached figures, in which.

DETAILED DESCRIPTION OF THE INVENTION

Figure 1:
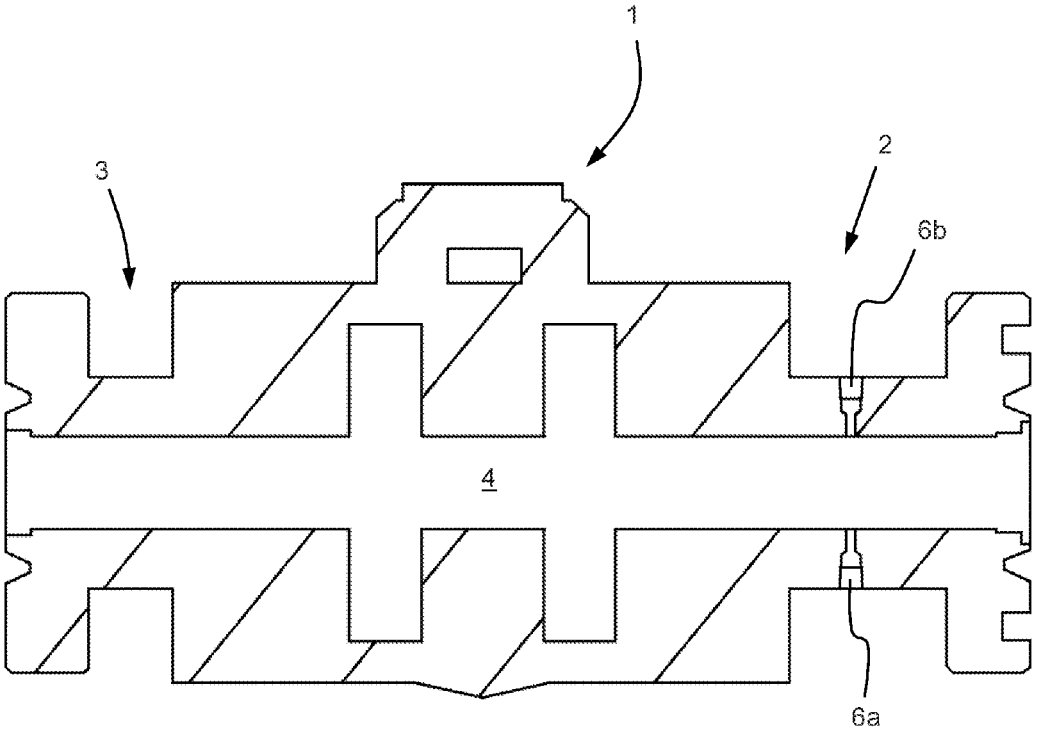
FIG. 1 illustrates a principle view of a valve according to the invention.

FIG. 1 illustrates a principle view of a valve 1 according to the invention. The valve 1 comprises two flange portions, a first flange portion 2 and a second flange portion 3. Furthermore there is a through-going main channel 4, which extends through the valve 1 and which, on activation thereof, is closed and/or opened for through-flow. The main channel 4 extends through the flange portions 2, 3 and will normally be positioned in line with an outlet to which the valve is secured. In this embodiment the first flange portion 2 has two bores 6*a* and 6*b*, extending from an outside of the flange portion to the main channel 4 of the valve.

Figure 2:
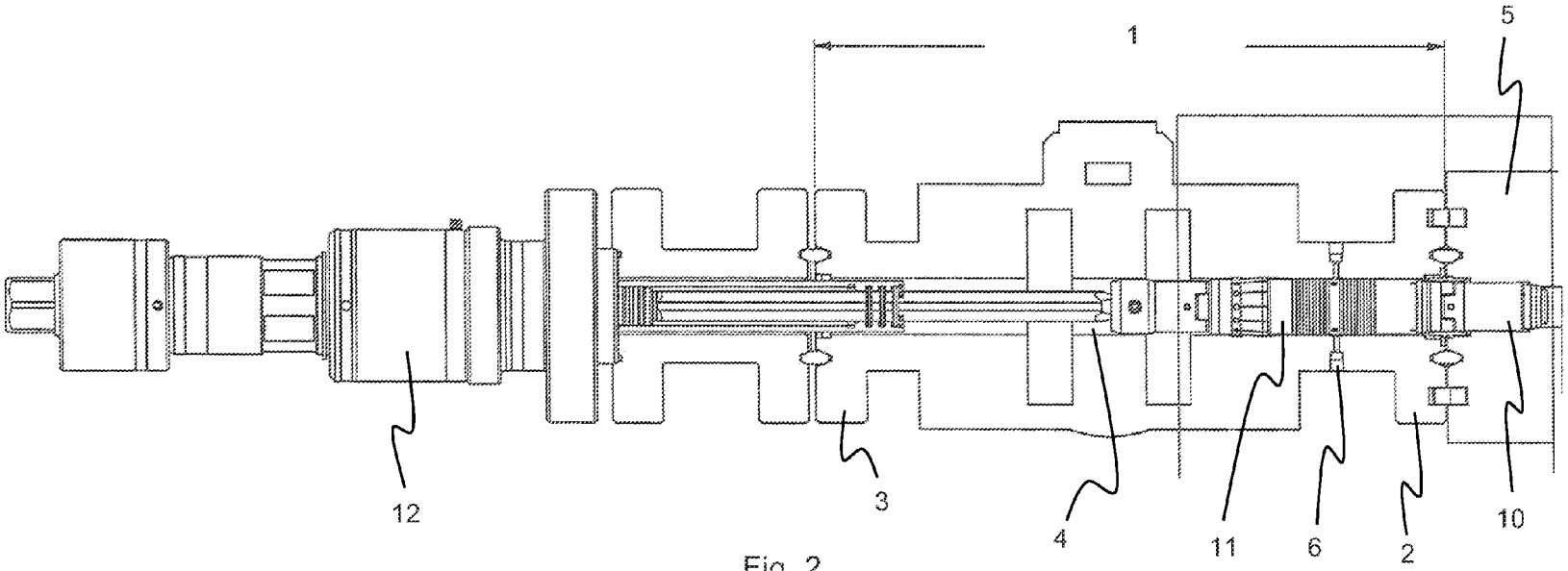
FIG. 2 illustrates such a valve assembled together with a part of a wellhead Christmas tree, with a tool arranged for installation of the unit in the outlet bore of the Christmas tree.
Figure 3:
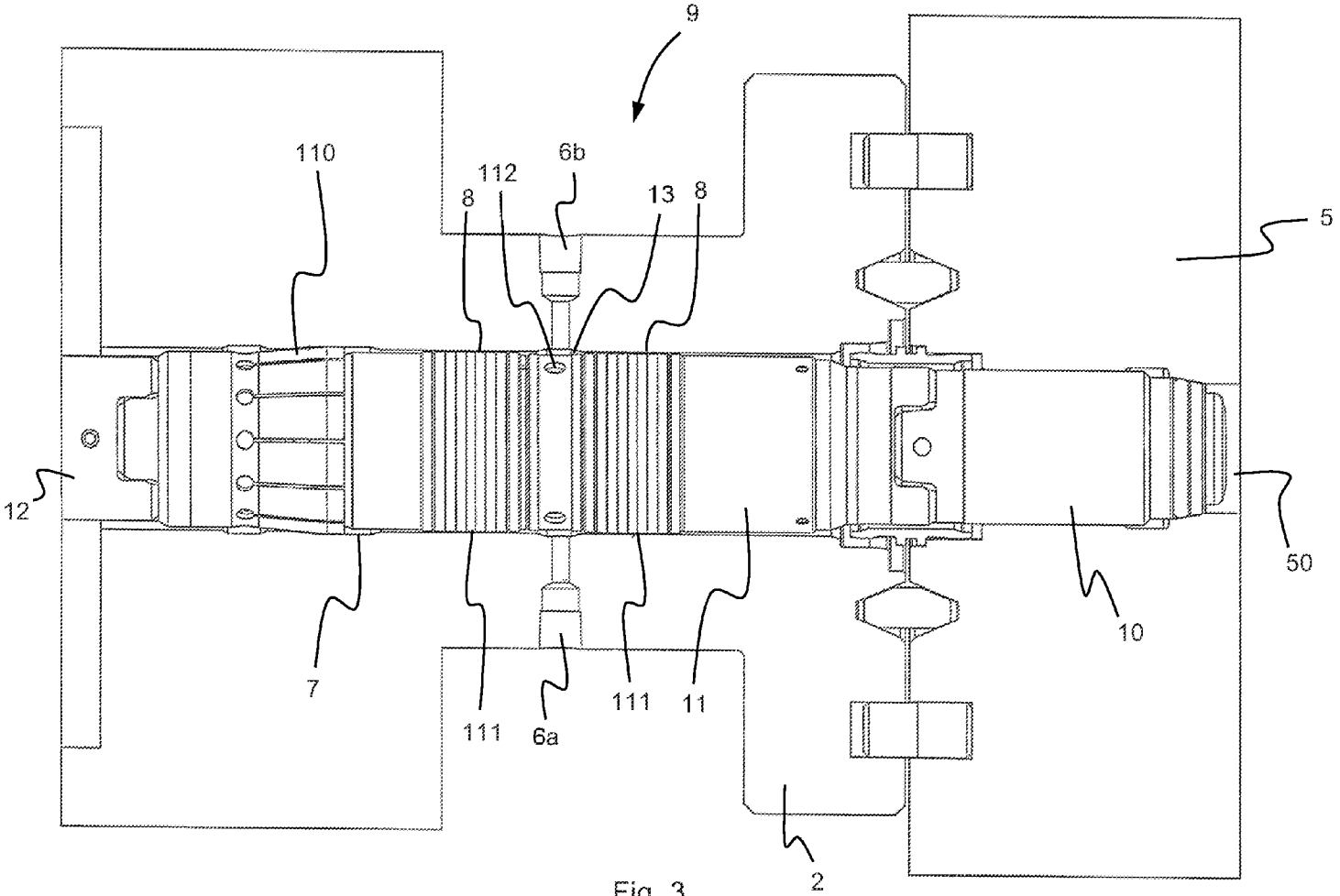
FIG. 3 illustrates a detail of FIG. 2.

In FIG. 2 the valve in FIG. 1 is illustrated secured to a wellhead Christmas tree 5 so that the main channel 4 is aligned with an outlet 50 (see FIG. 3) of the Christmas tree 5. In this outlet bore 50 a unit 10 is mounted, which in this case is a valve 10. The figure depicts a case where the valve 10 and a control unit 11 for it are installed by an installation tool 12. A part of FIG. 2 is shown in greater detail in FIG. 3. In this figure it can be seen that the main channel 4 of the valve is provided with anchor surfaces 7 for receiving anchors 110 on the control unit 11 for the valve 10 installed in the outlet bore 50 of the wellhead Christmas tree 5. The main channel 4, moreover, has two sealing surfaces 8 which interact with seals 111 on the control unit 11, thereby forming an annulus 13 in connection with the bores 6*a*, 6*b* from an outside of the flange portion 2 to a main channel 4. This annulus 13 thereby transfers fluid from the bores 6*a*, 6*b* to fluid openings 112 in the control unit. The flange portion 2 furthermore has an external recess 9.

Figure 4A:
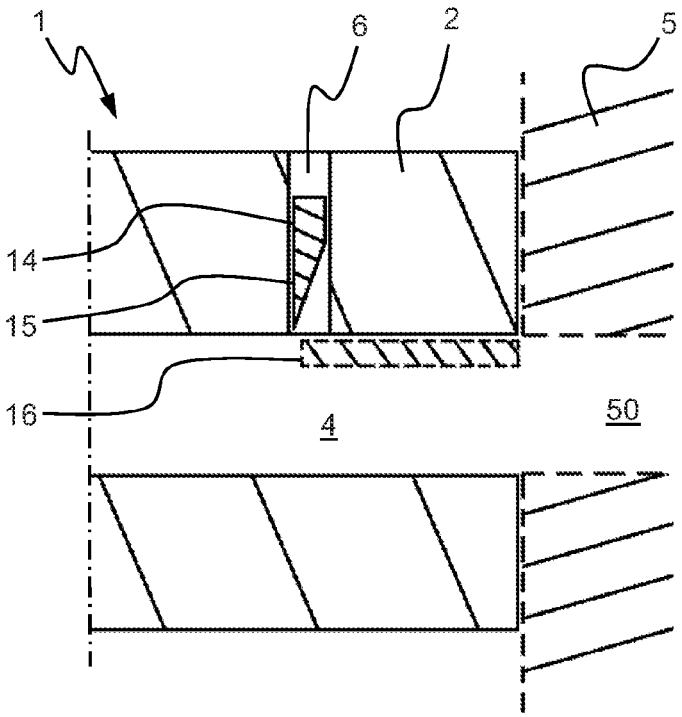
FIG. 4*a* and FIG. 4*b* illustrate a principle view of an alternative flange portion according to the invention.
Figure 4B:
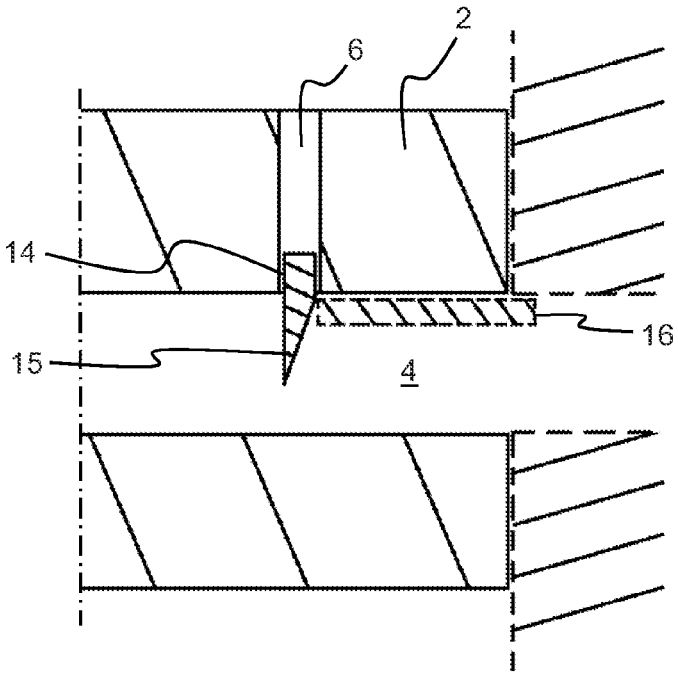

In FIGS. 4*a* and 4*b* a principle view is illustrated of an alternative embodiment of a flange portion for a valve according to the invention. The valve 1, which may be similar to that in FIG. 1, has an alternative flange portion 2. The flange portion 2 has a main channel 4 and a bore 6 extending from an outside to the main channel 4 in the flange portion. In this bore 6 parts 14, 15 of a control unit are mounted for a valve which has to be placed in an outlet bore 50 of a wellhead Christmas tree 5 to which the valve 1 is to be secured.

The parts comprise a piston unit 14 which is mounted in the bore 6, where a first mechanical actuation part 15 is secured to this piston unit 14. By pressurising the piston 14, for example hydraulically from the outside of the flange portion 2, it will be moved towards the main bore 6, whereupon the first actuation part 15 is moved from a position outside the main channel 4 to a position partly internally in the main channel 4. In this position it can interact with a second actuation part 16 located in the main channel 4 and extending in the longitudinal direction thereof. By interacting with the first actuation part 15, the second actuation part 16 is moved in the longitudinal direction of the main channel 4 and by means of this movement will be able to actuate a valve placed in the outlet bore 50 in the wellhead Christmas tree 5.

The invention has now been explained with reference to a non-limiting example. A person skilled in the art will appreciate that modifications and changes may be made to this embodiment which will be within the scope of the invention as defined in the following claims.

The invention claimed is:

1. A wellhead Christmas tree assembly, comprising:

a wellhead Christmas tree including a pipe outlet;

a first valve, connecting with the wellhead Christmas tree, the first valve includes a through-going main channel extending through the first valve and being aligned with the pipe outlet of the Christmas tree, an exterior of the first valve including a flange portion securing the first valve to the wellhead Christmas tree;

a second valve, being a barrier valve providing a fail safe closed position, mounted inside the pipe outlet of the wellhead Christmas tree; and a control mechanism configured to operate the second valve, the control mechanism including a structure integrally formed on a section, which is adjacent to the wellhead Christmas tree and comprises said flange portion, of the first valve.

2. The wellhead Christmas tree assembly according to claim 1, wherein the structure comprises at least one bore from an outside of the flange portion to the main channel of the first valve.

3. The wellhead Christmas tree assembly according to claim 1 or 2, wherein the structure comprises arrangements for activation of a mechanical device for operation of the second valve.

4. The wellhead Christmas tree assembly according to claim 2, wherein the main channel is configured to receive a control unit can be connected to the bore for activation of the second valve.

5. The wellhead Christmas tree assembly according to claim 4, wherein the main channel comprises anchor surfaces for mounting the control unit for the second valve.

6. The wellhead Christmas tree assembly according to claim 4 or 5, wherein the main channel comprises at least one sealing surface.

7. The wellhead Christmas tree assembly according to one of claim 1, 2, 4 or 5, wherein the second valve is a valve which regulates through-flow through the main channel.

8. The wellhead Christmas tree assembly according to one of the claim 4 or 5, wherein the control unit is mounted internally in the main channel in the first valve, and wherein the main channel and control unit are configured in such a manner that a diameter of the main channel is maintained in the portion where the control unit is mounted.

* * * * *